US005810949A

United States Patent [19]

Chakrabarti et al.

[11] Patent Number: 5,810,949

[45] Date of Patent: Sep. 22, 1998

[54] METHOD FOR TREATING AN ALUMINUM ALLOY PRODUCT TO IMPROVE FORMABILITY AND SURFACE FINISH CHARACTERISTICS

[75] Inventors: Dhruba J. Chakrabarti, Export, Pa.; Robert W. Westerlund; Bruce A. Halter, both of Bettendorf, Iowa

[73] Assignee: Aluminum Company of America, Pittsburgh, Pa.

[21] Appl. No.: 473,827

[22] Filed: Jun. 7, 1995

[51] Int. Cl.[6] ..... C22C 1/057

[52] U.S. Cl. ..... 148/535; 148/694; 148/698; 148/700

[58] Field of Search ..... 148/694, 695, 148/698, 700, 415, 417, 437, 439, 535; 428/654

[56] References Cited

U.S. PATENT DOCUMENTS

| | | | |
|---|---|---|---|
| 4,092,181 | 5/1978 | Paton et al. | 148/698 |
| 4,618,382 | 10/1986 | Miyagi et al. | 148/415 |
| 4,784,921 | 11/1988 | Hyland et al. | 148/439 |
| 4,840,852 | 6/1989 | Hyland et al. | 148/439 |
| 4,927,470 | 5/1990 | Cho | 148/439 |
| 4,946,517 | 8/1990 | Cho | 148/439 |
| 5,028,276 | 7/1991 | Byrne et al. | 148/439 |
| 5,213,639 | 5/1993 | Colvin et al. | 148/439 |

OTHER PUBLICATIONS

Sanders et al, "The Effect of Intermediate Thermomechanical Treatments on the Fatigue Properties of a 7050 Aluminum Alloy" *Metallurgical Transactions A,* vol. 9A, Aug. 1978, pp. 1087–1100.

Waldman et al, "The Effect of Ingot Processing Treatments on the Grain Size and Properties of Al Alloy 7075", *Metallurgical Transactions,* vol. 5, Mar. 1974, pp. 573–584.

*Primary Examiner*—George Wyszomierski
*Attorney, Agent, or Firm*—David J. Hill; David W. Pearce-Smith

[57] ABSTRACT

A method is disclosed for treating an aluminum alloy product in order to impart a fine grain structure and thereby improve formability and surface finish characteristics. According to this method, the product is first heated to a first temperature high enough to dissolve soluble constituent phase particles into solid solution. The product is maintained at this first temperature long enough to dissolve a major portion of the soluble constituent phase particles. Thereafter, the product is subjected to a controlled cooling process. The product is first cooled from the first temperature, at a first rate that is rapid enough to minimize the precipitation of coarse-grained constituent phase particles, to a second temperature that is below the temperature at which such coarse-grained constituent phase particles will precipitate out. Then, the product is cooled from the second temperature, at a second rate that is within a range of about 1–300 degrees F. per hour, to a third temperature that is at least 50 degrees F. below the second temperature. After the temperature of the product has been reduced to the third temperature, the product is cold worked. After cold working, the temperature of the product is raised to a fourth temperature sufficient to cause recrystallization of the product. The product so treated will exhibit improved formability and surface characteristics, and may exhibit an average grain size of less than about 30 microns.

51 Claims, 4 Drawing Sheets

METHOD FOR TREATING AN ALUMINUM ALLOY PRODUCT TO IMPROVE FORMABILITY AND SURFACE FINISH CHARACTERISTICS

FIELD OF THE INVENTION

This invention relates generally to aluminum alloys, and more particularly, to a method for treating products comprised of such alloys in order to impart a fine grain structure and thereby improve the formability and surface finish characteristics of the product. The invention is particularly useful in treating aluminum alloy sheet and plate products that may be suitable for use in aircraft and automotive applications.

BACKGROUND AND DESCRIPTION OF THE PRIOR ART

It is known that the composition of a particular aluminum alloy can be selected so that a product made therefrom will possess a desirable set of properties or physical characteristics. The desirable properties of strength, ductility, fracture toughness and resistance to fatigue crack initiation and growth, corrosion resistance, and formability, among others, may be affected to a significant degree by variations in alloy composition.

It is also known that aluminum alloys can be used in various aircraft and automotive applications, where any or all of the aforementioned properties may be important, depending on the particular application. Both heat-treatable and non-heat-treatable aluminum alloys have been considered for such uses. While heat-treatable alloys are generally preferred for aircraft applications because of the higher strength that products made from such alloys may possess, both heat-treatable and non-heat-treatable alloys may be utilized to make products for automotive applications.

Among the various aluminum alloy products that may be used in aircraft and automotive applications are sheet and plate products. Such products will require certain specified characteristics, depending on their use. Sheet and plate products that are used for the fuselage and wings of aircraft, for example, must possess desirable characteristics of strength, ductility, formability and other damage tolerant (fatigue and fracture toughness) and durability (various types of corrosion resistance) properties, and they must also exhibit excellent surface finish characteristics. While the strength and fracture toughness of automobile body sheet may not be as important as that of aircraft sheet, the characteristics of good formability and excellent surface finish are very desirable for such applications.

In addition to the effects of alloy composition on the properties of aluminum alloy products made therefrom, such products can also be subjected to various treatments in order to improve or enhance certain properties. Such treatments may include, for example, solution treatments, mechanical deformation processes and precipitation processes. The strength, ductility, fracture toughness, fatigue properties, corrosion resistance and formability of an aluminum alloy product may be affected to a significant degree by an application of an appropriate treatment.

A fine grain size is a desirable characteristic of aluminum alloys, as well as other materials that are to be formed into various products. A fine grain structure will tend to improve the formability of such alloys and provide an excellent finish for products that may be used for the exterior surfaces of automobiles or of the fuselage and wings of aircraft, among others. In addition, a fine grain structure may decrease the susceptibility of aluminum alloys to stress corrosion. However, significant grain refinement has been difficult to achieve in aluminum alloys.

One method for imparting a fine grain recrystallized structure to aluminum alloys having precipitating constituents is described in U.S. Pat. No. 4,092,181 of Paton et al. The alloy is first heated to a solid solution temperature to dissolve the precipitating constituents. The alloy is then cooled rapidly, preferably by water quenching, to a temperature that is below the solution heat treating temperature, and then over-aged to form precipitates. As described by Paton et al., over-aging consists of heating the alloy above its precipitation hardening temperature but below its solution heat treating temperature and holding it at this temperature for a period of time greater than is known for precipitation hardening treatment. According to Table 1 of the Paton reference, the times appropriate for a precipitation hardening treatment for various alloys range from as little as 5 hours to as much as 10 days. Strain energy is then introduced into the alloy by plastically deforming it, so as to reduce its thickness by at least 15% and preferably 40%, at a temperature which is at or below the over-aging temperature used. The alloy is then subsequently held at a recrystallization temperature so that the new grains are nucleated by the over-aged precipitates and the development of these grains results in a fine recrystallized grain structure. The method of Paton et al. reportedly produces fine grains having average diameters on the order of 10 microns in a variety of alloys; however, the process requires three separate heating steps and is therefore energy-intensive. In addition, its over-aging step is quite time-consuming, and because of these limitations, the process could not be accomplished in conjunction with operation of a continuous production/treatment line.

Another method for improving the grain structure of particular aluminum alloys is described in two Hyland et. al., U.S. Pat. Nos. 4,784,921 and 4,840,852. Two particular aluminum alloy compositions are described, along with a treatment method that is suitable for producing a sheet product comprised of such alloys that has improved grain structure and high forming capabilities. The alloy contains, by weight, 0.5 to 0.85% Si, 0.25 to 0.55% Mg, 0.05 to 0.4% Fe, 0.75 to 1.0% Cu, and 0.1 to 0.5% Mn (U.S. Pat. No. 4,784,921) or less than 0.08% Mn (U.S. Pat. No. 4,840,852), with the balance essentially aluminum and incidental elements and impurities. The method of Hyland includes solution heat treating a hot-rolled sheet of the alloy to substantially dissolve soluble elements. The solution heat treatment is carried out at a temperature within the range of 900–1100 degrees F., and preferably within the range of 1000–1070 degrees F., for a period of one-half to four minutes. Thereafter, the sheet is rapidly quenched at a rate of at least 10 degrees F. per second, and preferably 300 degrees F. per second, from the solution temperature to 350 degrees F. or less. After the metal has reached a temperature of about 350 degrees F., it may be air cooled, and subsequently aged. The treated alloy product of Hyland et al. has a grain size distribution of at least 15,000 grains/mm$^3$, with typical grain size distributions within the range of 25,000–40,000 grains/mm$^3$. The average diameter of such grains corresponding to a grain size distribution of 40,000 grains/mm$^3$ is greater than 35 microns. Although the grain size distribution obtained from the Hyland treatment may be suitable for many applications, it is not sufficiently fine for several other applications.

Therefore, as can be seen from the foregoing discussion, although processes have been developed for improving the fine grain structure and hence the formability and surface finish characteristics of aluminum alloy products, all such known processes are subject to various limitations and disadvantages.

OBJECTS AND ADVANTAGES OF THE INVENTION

Accordingly, it is an object of the invention claimed herein to provide a process for treating aluminum alloy products in order to impart a fine grain structure and thereby improve the formability and surface finish characteristics of the products. It is another object of the invention to provide such a process which can be operated using less energy than known processes. It is yet another object of the invention to provide such a process that can be carried out in conjunction with the operation of a continuous production/treatment line.

It is another object of the invention to provide such a process which may be applied to improve the fine grain structure of a variety of aluminum alloys. It is still another object of this invention to provide such a process that may be useful in treating aluminum alloy sheet and plate products that may be suitable for use in aircraft and automotive applications. It is yet another object of this invention to provide such a process that may be useful in treating aluminum alloy extrusions and forged products.

It is another object of this invention to provide a process for improving the formability and surface finish characteristics of an aluminum alloy product by developing in such product an average grain diameter of less than about 30 microns.

Additional objects and advantages of this invention will become apparent from an examination of the drawings and the ensuing description.

SUMMARY OF THE INVENTION

A method is disclosed for treating an aluminum alloy product in order to impart a fine grain structure and thereby improve formability and surface finish characteristics. According to this method, the product is first heated to a first temperature high enough to dissolve soluble constituent phase particles into solid solution. The product is maintained at this first temperature long enough to dissolve a major portion of the soluble constituent phase particles. Thereafter, the product is subjected to a controlled cooling process. According to this process, the product is cooled from the first temperature, at a first rate that is rapid enough to minimize the precipitation of coarse-grained constituent phase particles, to a second temperature that is below the temperature at which such coarse-grained constituent phase particles will precipitate out. The first rate should desirably be at least about 25 degrees F. per hour, and preferably at least about 100 degrees F. per hour. Then the product is cooled from the second temperature, at a second rate that is within a range of about 1–300 degrees F. per hour, and preferably less than 50 degrees F. per hour, to a third temperature that is at least 50 degrees F. below the second temperature. After the temperature of the product is reduced to the third temperature, the product is cold worked. After cold working, the temperature of the product is raised to a fourth temperature sufficient to cause recrystallization of the product. The product so treated will exhibit a fine grain structure that improves its formability and surface characteristics.

In order to facilitate an understanding of the invention, several embodiments of the invention are illustrated in the drawings, and a detailed description of the preferred embodiments follows. It is not intended, however, that the invention be limited to the particular embodiments described or to use in connection with the apparatus described. Various changes are contemplated such as would ordinarily occur to one skilled in the art to which the invention relates.

DESCRIPTION OF THE PREFERRED EMBODIMENTS OF THE INVENTION

Figure 1:
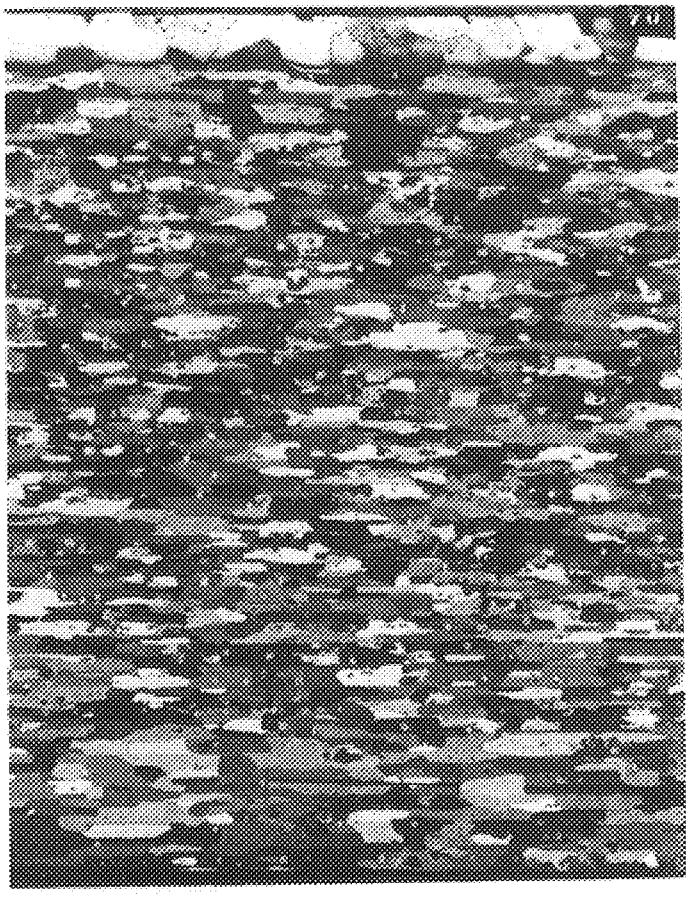
FIG. 1 is a photomicrograph of the microstructure of an AA2024 sheet product showing the typical grain size imparted to products treated according to a previously known process.

The invention is useful in treating aluminum alloys containing at least about 75% by weight aluminum and one or more alloying elements. Among such alloying elements is the group consisting of copper, iron, lithium, magnesium, manganese, silicon and zinc. These alloying elements are considered to be "essentially character forming" elements, because alloys that contain one or more of such elements derive certain characteristic properties from such elements. Although iron and silicon are included in this group of essentially character forming elements, they may also be considered to be undesirable impurities when present in certain quantities. Generally, the amounts of such elements which, if present in an alloy, will impart desirable characteristic properties are (expressed as percentage by weight of the total alloy) 0.2–7.0% copper, 0.3–2.0% iron, 0.2–3.0% lithium, 0.5–10.0% magnesium, 0.15–2.0% manganese, 0.3–1.5% silicon, and 0.05–9.0% zinc.

Aluminum alloys may contain, either with or without the aforementioned character forming elements, quantities of certain well-known ancillary alloying elements which serve to enhance particular properties. Such ancillary elements include bismuth, boron, cadmium, chromium, lead, manganese, nickel, tin, titanium, vanadium and zirconium. Generally, the amounts of such elements which, if present in an alloy, will desirably enhance particular properties are (expressed as percentage by weight of the total alloy) 0.3–0.7% bismuth, 0.05–0.5% cadmium, 0.05–0.4% chromium, 0.3–0.7% lead, 0.15–1.5% manganese, 0.05–0.4% nickel, 0.3–0.7% tin, 0.01–0.25% titanium, 0.05–0.25% vanadium and 0.05–0.25% zirconium.

Aluminum alloy compositions are described herein according to Aluminum Association alloy designations. Wrought alloys (sheet and plate, extrusions and forgings) are generally designated by the letters "AA" followed by four numerals. The first numeral defines the major alloying element. Most alloys contain two to four other elements, but in smaller percentages than the major element.

When specific alloy compositions are described herein, the permissible ranges for the various elements that may be included in the composition are listed in percentages, by weight, unless otherwise specified.

A series of related or similar alloys may be described as the Aluminum Association "2XXX Series", for example. Such description of a series of alloys is intended to include any wrought alloy which has been designated by the Aluminum Association with a "2" as the first numeral, indicating that its major alloying element is copper. Thus, AA2XXX includes an alloy that may be designated "AA2000", as well as an alloy that may be designated "AA2999", as well as any alloy having a numerical designation between "2000" and "2999". In addition, a subgroup of similar or related alloys may be described by a designation such as "AA2X17", which includes alloys that may be designated as follows: AA2017, AA2117, AA2217, AA2317, AA2417, AA2517, AA2617, AA2717, AA2817 and AA2917. Additional information about these alloy designations may be obtained by consulting the "Registration Record of International Alloy Designations and Chemical Composition Limits For Wrought Aluminum and Wrought Aluminum Alloys" published by the Aluminum Association in Washington, D.C.

Temper designations are also specified by the Aluminum Association. The temper designation tells how the product was fabricated. Some temper designations describe alloys and product forms that receive and respond to a thermal treatment after fabrication. These alloys are said to be heat-treatable. Wrought alloys in the 2XXX, 6XXX and 7XXX series are generally in this group. Non-heat-treatable alloys gain their strength and other properties by strain hardening, and a different temper designation is specified for such alloys. Included in this group are the 1XXX, 3XXX and 5XXX series of wrought alloys.

Aluminum based alloys which respond to treatment according to the present invention in order to impart a fine grain structure and thereby improve the formability and surface finish characteristics of a product made therefrom include both heat-treatable and non-heat-treatable alloys. The invention may be applied, therefore, to a variety of aluminum alloys, such as those classified according to the Aluminum Association 2XXX Series, the 5XXX Series, the 6XXX Series and the 7XXX Series, among others.

Examples of alloys classified according to the 2XXX Series include AA2008, AA2014, AA2017, AA2X18, AA2X19, AA2X24, AA2034, AA2036, AA2090, AA2091, AA2195 and AA2097, although this listing is not to be construed as limiting in any way the application of the invention to other alloys in the 2XXX Series. Typically, such 2XXX Series alloys contain 0.7–6.8% Cu, 0–1.9% Mg, 0–1.3% Si and 0.1–0.9% Mn, with the remainder substantially aluminum, incidental elements and impurities.

Examples of alloys classified according to the 5XXX Series include AA5030, AA5X52, AA5X54, AA5X57, AA5X82, AA5X83, AA5085 and AA5086, although this listing is not to be construed as limiting in any way the application of the invention to other alloys in the 5XXX Series. Typically, such 5XXX Series alloys contain 0.5–10.0% Mg, 0.1–1.5% Mn and 0.1–0.3% Cr, with the remainder substantially aluminum, incidental elements and impurities.

Examples of alloys classified according to the 6XXX Series include AA6009, AA6010, AA6X11, AA6013, AA6061 and AA6X63, although this listing is not to be construed as limiting in any way the application of the invention to other alloys in the 6XXX Series. Typically, such 6XXX Series alloys contain 0.4–1.5% Mg, 0.3–1.7% Si, 0.1–1.2% Cu, 0–1.1% Mn and 0–0.4% Cr, with the remainder substantially aluminum, incidental elements and impurities.

Examples of alloys classified according to the 7XXX Series include AA7005, AA7021, AA7029, AA7039, AA7049, AA7010, AA7X75, AA7X50, AA7055 and AA7178, although this listing is not to be construed as limiting in any way the application of the invention to other alloys in the 7XXX Series. Typically, such 7XXX Series alloys contain 1.5–9.0% Zn, 0.7–3.0% Mg, 0–2.6% Cu, 0–0.8% Mn, 0–0.35% Cr and 0–0.20% Zr, with the remainder substantially aluminum, incidental elements and impurities.

It should be understood, however, that the invention may be applied to other alloys than those specified herein. Furthermore, the invention may be applied to improve the grain size distribution and hence the formability and surface finish characteristics of an aluminum alloy sheet or plate product having a cladding on either or both sides. Such clad or composite products typically utilize a core of a particular aluminum alloy and a cladding of higher purity alloy which protects the core against corrosion. The cladding typically includes essentially unalloyed aluminum or aluminum containing not more than about 1.0% of all other elements. Cladding alloys may therefore include alloys of the Aluminum Association 1XXX Series, such as AA1045, AA1060, AA1100, AA1135, AA1145, AA1170, AA1180, AA1185, AA1188, AA1199, AA1200, AA1230, AA1235, AA1250, AA1285, AA1345 and AA1350. Other alloys, such as AA6003, AA6253 and AA7072, may also be used as cladding alloys, so long as they provide sufficient protection against corrosion to the core alloy. The clad layer or layers are much thinner than the core, with each clad layer constituting no more than about 25%, and often much less, of the total composite thickness. Clad alloy sheet products are often used in the manufacture of aircraft fuselage, among other products.

The alloy stock to be treated according to the invention may be an intermediate-gauge or final-gauge sheet or plate product that has been formed from an ingot or slab by a hot or cold rolling process. However, other formed and/or machined alloy products may benefit from treatment according to the invention, including forged products such as aircraft components and aluminum wheel rims, extruded tubes, shapes and bars, and other rolled products including slabs and foil products. The invention may also be useful in treating parts machined from such fabricated products.

The product is treated according to the present invention in order to impart a fine grain structure and thereby improve the formability and surface finish characteristics of the product. The Table includes a listing of preferred ranges for the operative steps of the invention for a group of selected alloys among those to which the invention may be applied.

TABLE

| ALUMINUM ALLOY | FIRST TEMP. (DEGREES F.) | SOAK TIME (HOURS) | FIRST RATE (DEGREES F./HOUR) | SECOND TEMP. (DEGREES F.) | SECOND RATE (DEGREES F./HOUR) | THIRD TEMP. (DEGREES F.) | FOURTH TEMP. (DEGREES F.) |
|---|---|---|---|---|---|---|---|
| | PREFERRED RANGES | | | | | | |
| 2X24 | 900–930 | 0.25–4.0 | 25–300 | 700–750 | 10–25 | 400–500 | 700–930 |
| 7X75 | 870–900 | 0.25–4.0 | 25–300 | 650–800 | 10–50 | 400–500 | 600–900 |
| 7X50 | 870–900 | 0.25–4.0 | 25–300 | 650–800 | 10–50 | 400–500 | 600–900 |
| 7055 | 860–880 | 0.25–4.0 | 25–300 | 650–800 | 10–50 | 400–500 | 600–880 |
| 6013 | 900–940 | 0.25–4.0 | 25–300 | 650–800 | 10–50 | 400–500 | 600–940 |
| 6010 | 900–940 | 0.25–4.0 | 25–300 | 650–800 | 10–50 | 400–500 | 600–940 |
| 2008 | 900–940 | 0.25–4.0 | 25–300 | 650–800 | 10–50 | 400–500 | 600–940 |
| 2219 | 975–1025 | 0.25–4.0 | 25–300 | 650–800 | 10–50 | 400–500 | 600–1025 |
| 6061 | 980–1040 | 0.25–4.0 | 25–300 | 650–950 | 10–50 | 400–500 | 600–1040 |

The invention is particularly useful in treating aluminum alloy sheet and plate products that may be suitable for use in aircraft and automotive applications, as has been mentioned. One alloy product that may be used for such applications is AA2024, a form of which is a preferred fuselage material for aircraft.

AA2024 sheet products for such applications have been produced according to known hot rolling processes, wherein the starting temperature is typically within the range of 800–850 degrees F. According to such a process, an ingot having a typical beginning thickness of sixteen inches or so is subjected to a series of passes in a hot rolling mill to reduce its thickness to a finished hot line gauge within the range of about 0.100–0.250 inches. Thereafter, according to the known process, the hot line gauge product is subjected to an annealing process at about 650 degrees F. for about two hours. Subsequently, the product is cooled at a rate of typically 25 degrees F. per hour to about 400 degrees F. The product is then allowed to cool to room temperature by contact with the air, and subjected to a first pass in a cold rolling mill to reduce the thickness to another intermediate gauge (which can also be the finish gauge for some products) within the range of about 0.05–0.09 inches. If the thickness of the product has not been reduced to the final gauge, the product is then be subjected to one or more additional cold rolling passes to reduce its thickness to the final gauge. If a subsequent cold rolling pass is utilized, there may be intermediate annealing steps interposed therebetween. Then the product is subjected to a solution heat treatment at a temperature within the range of about 910–930 degrees F. for a period of time that may be as little as a few minutes or as long as several hours. After solution heat treatment, the product is quenched, preferably using ambient temperature water sprays or immersion in ambient temperature water. It may be aged thereafter and/or stretched to impart desirable properties. The average grain size of such product made according to the known process described herein will typically be within the range of about 35–45 microns. Such grain size may be suitable for many uses, but it will be insufficiently fine for other applications.

It has been found, however, that the present invention may be applied to substantially reduce the average grain size of the product so as to improve its formability and surface finish characteristics. According to the invention, the product is heated to a first temperature high enough to dissolve soluble constituent phase particles into solid solution. Good results have generally been obtained when the first temperature is within a range from about 50 degrees F. below the solvus temperature to about 100 degrees F. above the solvus temperature, although a preferred range for a particular alloy may be less broad. In addition, certain alloys, including AA2X24 and AA2219, may exhibit localized eutectic melting at a temperature that is near or below the solvus temperature, and for such alloys, the acceptable range is below the temperature at which such localized melting occurs. In any case, the first temperature should not be so high that non-equilibrium eutectic melting or solidus melting of the alloy will occur. The Table lists a range of preferred first temperatures for selected alloys among those to which the invention may be applied. As shown therein, the preferred first temperatures for the alloys listed are within the range of about 800°–1100° F. and preferably about 860–1040 degrees F. For AA2024, for example, the first temperature is preferably within the range of about 900–930 degrees F.

As has been mentioned, the heating of the product to the first temperature is carried out to dissolve or substantially dissolve soluble intermetallic compounds that remain from casting or may have precipitated during the preceding hot rolling process. Such intermetallic compounds are comprised of aluminum and at least one other element, and they are generally characterized herein as constituent particles. The majority of such particles are constituent phase particles that are formed during solidification of the ingot; however, as described herein, constituent particles may also include dispersoid particles that form by solid-state transformation during preheating/homogenization of the ingot. In alloy AA2024, such soluble constituent particles may include $Al_2CuMg$ and $Al_2Cu$, for example, as distinguished from substantially insoluble constituent particles such as $Al_7Cu_2Fe$ and partially soluble dispersoid particles such as $Al_{20}Cu_2Mn_3$. Raising the temperature of the product to a first temperature near or above the solvus temperature for the alloy of which the product is comprised helps in dissolving the soluble constituent phase particles into solid solution, thus increasing supersaturation of the alloy. This increases the precipitate volume, and under proper cooling conditions according to the invention, makes the precipitates more uniformly distributed and of an optimized intermediate size, as compared to the coarse particles found in clusters in the product before dissolution. In addition, in dissolving the original coarse particles, the practice of the invention prevents the nucleation of a few coarse recrystallized grains around those particles.

It is desirable that heating at the first temperature put most of the solute alloying elements into solid solution, and therefore, the product is maintained at the first temperature long enough to dissolve a major portion of the soluble constituent phase particles. Preferably, the product is maintained at the first temperature for a period of time within the range of about 15 minutes to about four hours. For clad products, the time at the first temperature should be at the short end of the range, so as to avoid diffusion of copper or other constituents from the core into the higher-purity cladding. Such diffusion can detrimentally affect the corrosion protection afforded by the cladding. The present invention serves to both increase the dissolution of the deleterious constituent particles and yet avoid excessive high temperature thermal exposure times (for clad products) that can cause diffusion into the cladding, or at least keep such diffusion within acceptable limits.

The Table lists a range of preferred maintenance (or soak) times at the preferred first temperatures for selected alloys among those to which the invention may be applied. As shown therein, the preferred maintenance times at the preferred first temperatures for the alloys listed are within the range of about 15 minutes–4 hours.

After the product is maintained at the first temperature for the appropriate period of time, it is cooled. It has been found that slow cooling of the product is required to produce a fine grain structure. However, it has also been discovered that cooling at too slow a rate from the first temperature through the range where precipitates form and coarsen very rapidly will lead to cracking of the product during subsequent cold working. Therefore, the invention includes a relatively fast cooling rate from the first temperature, through the range where precipitates form and coarsen very rapidly, to a second temperature. This first rate is selected for the particular alloy to minimize the precipitation of secondary phases such as, for example, $Al_2CuMg$ and $Al_2Cu$. The first rate is desirably at least about 25 degrees F. per hour, and preferably at least about 100 degrees F. per hour. The Table lists a range of preferred first cooling rates from the preferred first temperatures for selected alloys among those to which the invention may be applied. For AA2024, for example, the preferred first cooling rate is within the range of about 25–300 degrees F. per hour.

Cooling from the second temperature is then carried out at a second rate, which is selected so as to obtain in the product desirably fine grains, and which will usually be slower than the first rate. It should be appreciated that in the practice of the invention, the selection of a rapid first rate, to cool the product through the range where precipitates form and coarsen very rapidly, must be balanced with the selection of a second rate, preferably a slower rate, to cool the product so as to produce a fine grain structure. However, it should also be appreciated that the acceptable ranges for the first and second cooling rates of the invention are such that the first rate and the second rate may be selected, for some alloys, so as to be the same or nearly so. The rates are selected according to the invention therefore, to impose a controlled cooling process that will produce a fine grain structure and avoid cracking of the product during subsequent cold working.

As has been mentioned, the product is cooled from the first temperature at the first cooling rate to a second temperature that is below the temperature at which precipitates form and coarsen very rapidly. The Table lists a range of preferred second temperatures for selected alloys among those to which the invention may be applied. As shown therein, the preferred second temperatures for the alloys listed are within the range of about 650–950 degrees F. For AA2024, for example, the preferred second temperature is within the range of about 700–750 degrees F.

It is not required that the product be maintained at the second temperature for any period of time, although there are no deleterious effects obtained from some maintenance time at such temperature. From the second temperature, the product is cooled, at a second rate that is within a range of about 1–300 degrees F. per hour, and preferably less than 50 degrees F. per hour, to a third temperature that is at least 50 degrees F. below the second temperature. Significant grain refinement benefits are obtained when the third temperature is at least about 50 degrees F. below the second temperature, although in some cases, better grain refinement may be obtained if the third temperature is selected to be as low as about 400 degrees F. or less.

Since no maintenance or soak time at the second temperature is required, cooling from the first temperature may proceed through the second temperature to the third temperature in an uninterrupted fashion. The Table lists a range of preferred second cooling rates and third temperatures for selected alloys among those to which the invention may be applied. As shown therein, for AA2024, the second cooling rate will preferably be within the range of 10–25 degrees F. per hour, and the third temperature will preferably be within the range of 400–500 degrees F.

After the product is cooled to the third temperature, it may be further cooled by contact with the air to room temperature (if the third temperature is above room temperature), and subjected to a cold working process such as cold rolling. It is preferred that cold working of the product be carried out without any subsequent or intermediate annealing. Furthermore, if the cold working of the product comprises cold rolling to reduce the thickness of the product, it is preferred that a reduction in thickness of at least 10% be obtained in each cold rolling pass. It is also preferred that the number of cold rolling passes be minimized, and that the maximum reduction in thickness be obtained in the final cold rolling pass. Preferably, a total reduction in thickness within the range of 40–85% is obtained, with the greatest reduction obtained in the final cold rolling pass. Most preferably, a total reduction in thickness of at least 60% is obtained.

A high degree of cold reduction is preferred because it increases the number of recrystallized nuclei, due to lattice rotation around the particles and/or nucleation at shear/transition bands, and decreases the critical size of particles capable of nucleating recrystallized grains. This increases the available number of nuclei and thus refines the grain size. Intermediate annealing is not recommended between cold working steps, because it causes recovery to occur, thus lowering the stored energy of deformation. Thus, with intermediate annealing, fewer nuclei are formed, resulting in an increase in the grain size.

After cold working, the temperature of the product is raised to a fourth temperature sufficient to cause recrystallization of the product. For products comprised of heat-treatable alloys, it may be desirable that the fourth temperature be high enough to subject the product to solution heat treatment. In the alternative, the improved product could be provided to a user in an as-deformed (F-temper) or in a recrystallized but non-solution-heat-treated condition. If the product is heated to the fourth temperature so as to subject it to a solution heat treatment, it is preferred that the fourth temperature be near or even above the solvus temperature for the product, but not so high that non-equilibrium eutectic melting or solidus melting of the alloy will occur. The Table lists a range of preferred fourth temperatures (to cause recrystallization) for selected alloys among those to which the invention may be applied. As shown therein, for AA2024, the fourth temperature will preferably be within the range of 700–930 degrees F.

It is also preferred that the product be raised to the fourth temperature at a relatively fast rate, such that the increase to the fourth temperature is achieved within about four hours.

After recrystallization, the product is cooled, and if solution heat treatment has occurred, it is preferably cooled very rapidly, as by a cold water quench, to prevent or minimize the uncontrolled precipitation of secondary phases. After cooling, if desired, the product may be aged, by means of known procedures, and stretched or cold worked, also by means of known procedures, to improve strength or other mechanical properties.

Treatment of the product according to the method disclosed and claimed herein will impart to it a fine grain size that offers improved formability and surface finish characteristics. By treatment of the product according to the invention, an average grain size of less than about 30 microns, and in some cases, less than about 20 microns and even as low as 15 microns, can be produced.

The invention is suitable for use in connection with the production of sheet or plate products on a continuous production or treatment line, such as a continuous temper line, or it may be used in connection with a batch process.

In order to demonstrate the advantages of treatment according to the invention and the improvement in grain size that can be obtained by a practice thereof, several examples of the operation of the invention will be described, along with an example of a known process for treating an aluminum alloy product.

EXAMPLES

A version of AA2024 was used for the examples. Four direct chill cast ingots each having a composition (by weight) within the range of 0.061–0.065% Si, 0.18–0.20% Fe, 4.51–4.60% Cu, 1.44–1.51% Mg, 0.63–0.65% Mn, and 0.029–0.034% Ti, with the balance essentially aluminum, incidental elements and impurities, each weighing up to about 15,000 pounds and measuring about 16 inches thick, were utilized in the examples. Each ingot was homogenized at a temperature within the range of 910–925 degrees F. for a period of 10–30 hours. About 0.75 inches of each ingot was then scalped from each side, and the remaining 14.5 inch (approximately) ingot was then preheated and hot rolled at a beginning temperature of about 850 degrees F. to produce a slab having a thickness of 6.4 inches. The slab was then subjected to additional hot rolling passes to reduce its thickness to a plate thickness of 0.8 inches, and then to an intermediate gauge sheet thickness of 0.16 inches. The sheets so produced were then subjected to the operative steps described hereinafter.

Example 1 illustrates the known process for producing aluminum alloy sheet, while in Examples 2–4, the sheet was treated according to various embodiments of the invention. After treatment (as hereinafter described), conventional metallographic procedures were used to prepare samples of the sheet for optical microscopic examination. The samples were anodized and viewed under polarized light for observation of the grains. Grain intercept lengths were measured in three directions: L, LT and grain thickness, and the average diameter of the grains so measured was recorded.

EXAMPLE 1 (Prior Art)

The 0.16 inch sheet was annealed at 650 degrees F. for two hours and cooled in an air circulating furnace at a rate of about 25 degrees F. per hour to a temperature of about 400 degrees F. Thereafter, it was allowed to cool by contact with the air to room temperature and then subjected to a first pass in a cold rolling mill to reduce the thickness to a finish gauge thickness of 0.09 inches. Then the product was subjected to a continuous solution heat treatment in an air circulating furnace at a temperature of about 920 degrees F. After solution heat treatment, the product was quenched using ambient temperature water sprays and was allowed to cool to room temperature by contact with the air. It was then naturally aged and stretched by 0.5% of its length to impart desirable mechanical properties. The average grain size of product treated according to the known process, as described herein, was determined to be 35.2 microns. FIG. 1 is a photomicrograph of the microstructure of the AA2024 sheet treated according to the previously known process described in Example 1. This figure may be considered representative of the typical grain size imparted to products made and treated according to the known process.

EXAMPLE 2

Figure 2:
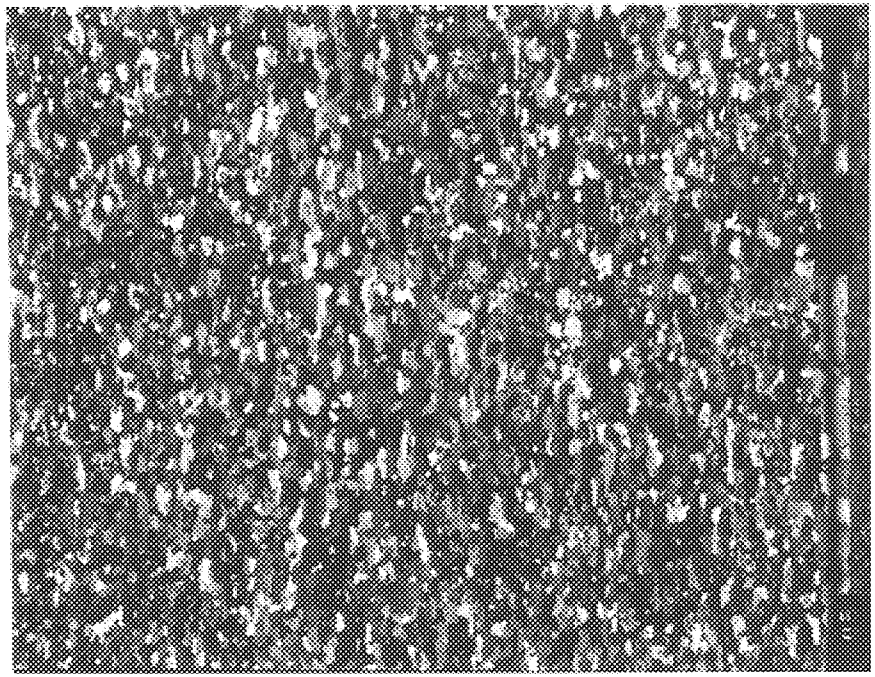
FIG. 2 is a photomicrograph of the microstructure of an AA2024 sheet product showing the grain size imparted to products treated according to a preferred embodiment of the invention.

The 0.16 inch sheet was heated to a first temperature of 920 degrees F., and it was maintained at the first temperature for one hour to dissolve a major portion of the soluble constituent phase particles. After the one-hour soak at the first temperature, the product was subjected to a controlled cooling process, according to the invention. From the first temperature, the product was cooled at a first rate of 160 degrees F. per hour to a second temperature of 750 degrees F. From the second temperature, the product was cooled at a second rate of 10 degrees F. per hour to a third temperature of 400 degrees F. After the product was cooled to the third temperature, it was further cooled by contact with the air to room temperature and subjected to two passes in a cold rolling mill to reduce the thickness from 0.16 inches to 0.09 inches and then to 0.05 inches. This cold working of the product was carried out without any subsequent or intermediate annealing step. After cold working, the temperature of the product was raised in an air furnace to a fourth temperature of 920 degrees F. to cause recrystallization of the product and to subject it to solution heat treatment. After recrystallization and solution heat treatment, the product was cooled by an ambient temperature water quench, and an average grain diameter of 22.3 microns was measured. FIG. 2 is a photomicrograph of the microstructure of the AA2024 sheet product showing the grain size imparted by treatment according to the preferred embodiment of the invention described in Example 2.

EXAMPLE 3

The 0.16 inch sheet product was treated according to the embodiment of the invention described in Example 2, except that an intermediate annealing step was interposed between the first cold rolling pass (that reduced the sheet thickness from 0.16 inches to 0.09 inches) and the second cold rolling pass (that reduced the sheet thickness from 0.09 inches to 0.05 inches).

Figure 3:
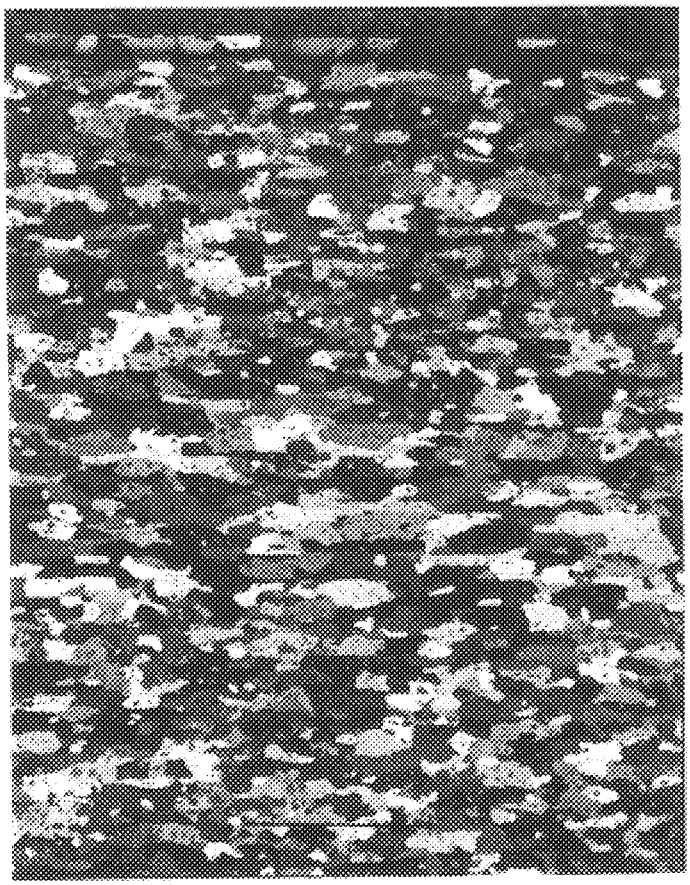
FIG. 3 is a photomicrograph of the microstructure of an AA2024 sheet product showing the grain size imparted to products treated according to the embodiment of the invention illustrated in FIG. 2, but with a less preferred, intermediate annealing step.

According to this less preferred embodiment of the invention, the 0.09 inch sheet was subjected to an anneal for two hours at a temperature of 650 degrees F., and then cooled in an air circulating furnace at a rate of about 25 degrees F. per hour to a temperature of about 400 degrees F. Thereafter, it was allowed to cool by contact with the air to room temperature and then subjected to the second cold rolling pass to reduce the thickness to the finish gauge thickness of 0.05 inches. An average grain diameter of 48.5 microns was measured for the product treated according to this embodiment of the invention, illustrating the deleterious effects of an intermediate anneal. FIG. 3 is a photomicrograph of the microstructure of the AA2024 sheet product showing the grain size imparted by treatment according to this less preferred embodiment of the invention that includes an intermediate anneal interposed between the cold rolling steps.

EXAMPLE 4

Figure 4:
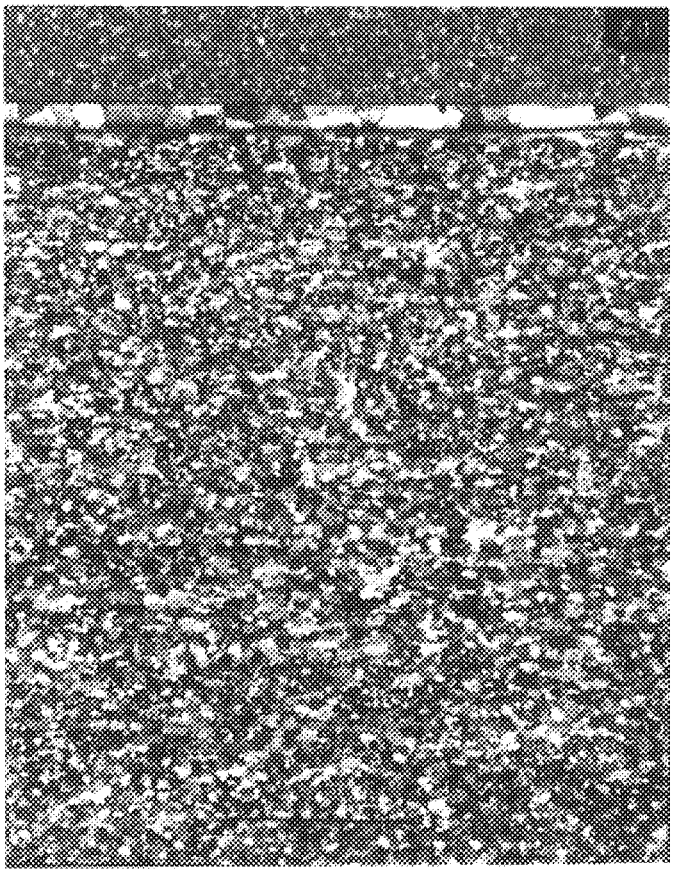
FIG. 4 is a photomicrograph of the microstructure of an AA2024 sheet product showing the grain size imparted to products treated according to another preferred embodiment of the invention.

The 0.16 inch sheet was heated to a first temperature of 920 degrees F., and it was maintained at the first temperature for one hour to dissolve a major portion of the soluble constituent phase particles. After the one-hour soak at the first temperature, the product was subjected to a controlled cooling process, according to the invention. From the first temperature, the product was cooled at a first rate of 25 degrees F. per hour to a second temperature of 750 degrees F. From the second temperature, the product was cooled at a second rate of 25 degrees F. per hour to a third temperature of 400 degrees F. After the product was cooled to the third temperature, it was further cooled by contact with the air to room temperature and subjected to two passes in a cold rolling mill to reduce the thickness from 0.16 inches to 0.09 inches and then to 0.05 inches. This cold working of the product was carried out without any subsequent or intermediate annealing step. After cold working, the temperature of the product was raised in a molten metal bath to a fourth temperature of 920 degrees F. to cause recrystallization of the product and to subject it to solution heat treatment. After recrystallization and solution heat treatment, the product was cooled by an ambient temperature water quench, and an average grain diameter of 19.8 microns was measured. FIG. 4 is a photomicrograph of the microstructure of the AA2024 sheet product showing the grain size imparted by treatment according to the embodiment of the invention described in Example 4.

Although this description contains many specifics, these should not be construed as limiting the scope of the invention but as merely providing illustrations of some of the presently preferred embodiments of this invention. Thus, the invention, as described herein, is susceptible to various modifications and adaptations, and the same are intended to be comprehended within the meaning and range of equivalents of the appended claims.

What is claimed is:

1. A method for treating an aluminum alloy product in order to improve formability and surface finish characteristics, which method comprises:

a) heating the product to a first temperature high enough to dissolve soluble constituent phase particles into solid solution;

b) maintaining the product at the first temperature long enough to dissolve a major portion of the soluble constituent phase particles;

c) cooling the product from the first temperature, at a first rate that is rapid enough to minimize the precipitation of coarse constituent phase particles, to a second temperature that is below the temperature at which such coarse constituent phase particles will precipitate out;

d) cooling the product from the second temperature, at a second rate that is within a range of about 1–100 degrees F. per hour, to a third temperature that is at least 50 degrees F. below the second temperature;

e) cold working the product; and f) heating the product to a fourth temperature sufficient to cause recrystallization.

2. The method of claim 1, wherein the first temperature is within a range from about 50 degrees F. below the solvus temperature for the alloy of which the product is comprised to about 100 degrees F. above the solvus temperature.

3. The method of claim 1, wherein the first temperature is within the range of 800–1050 degrees F.

4. The method of claim 1, wherein the product is maintained at the first temperature for at least about fifteen minutes.

5. The method of claim 1, wherein the first rate is at least about 100 degrees F. per hour.

6. The method of claim 1, wherein the second temperature is within the range of 650–800 degrees F.

7. The method of claim 1, wherein the second rate is less than about 50 degrees F. per hour.

8. The method of claim 1, wherein the third temperature is below 500 degrees F.

9. The method of claim 1, wherein the cold working of the product is carried out without any subsequent annealing.

10. The method of claim 9, wherein the cold working comprises cold rolling to reduce the thickness of the product.

11. The method of claim 10, wherein the cold rolling comprises one or more cold rolling passes and a reduction in thickness of at least 10% is obtained in each cold rolling pass.

12. The method of claim 10, wherein the maximum reduction in thickness is obtained on the final cold rolling pass.

13. The method of claim 12, wherein a total reduction in thickness of at least 40% is obtained.

14. The method of claim 1, wherein after the product is raised to the fourth temperature, it is cooled.

15. The method of claim 14, wherein after the product is cooled, it is aged.

16. The method of claim 1, wherein the temperature of the product is raised to the fourth temperature at a rate such that the increase to the fourth temperature is achieved within about four hours.

17. The method of claim 1, wherein the fourth temperature is high enough to subject the product to solution heat treatment.

18. The method of claim 17, wherein after the product is subjected to solution heat treatment, it is subjected to an ambient temperature water quench.

19. The method of claim 1, which imparts to the product an average grain size of less than about 30 microns.

20. The method of claim 1, wherein the product is in the form of a sheet or plate.

21. The method of claim 1, wherein the product comprises an aluminum alloy consisting essentially of about 3.8 to 4.8% by weight copper, about 1.2 to 1.8% by weight magnesium, about 0.3 to 0.9% by weight manganese, with the remainder substantially aluminum, incidental elements and impurities.

22. The method of claim 1 for treating a clad aluminum alloy product which comprises:

a) a core alloy consisting essentially of about 3.8 to 4.5% by weight copper, about 1.2 to 1.8% by weight magnesium, about 0.3 to 0.9% by weight manganese, with the remainder substantially aluminum, incidental elements and impurities; and b) a cladding on the core of aluminum or an aluminum alloy having a different composition from that of the core.

23. The method of claim 1 in which (d) is performed immediately after (c) without allowing the product to remain at the second temperature.

24. The method of claim 1 in which the product is cooled from the third temperature to cold working temperature prior to (e).

25. A method for producing an aluminum alloy sheet product comprising:

a) providing an ingot feedstock of an aluminum alloy;

b) hot rolling the ingot feedstock to produce a sheet or plate product;

c) heating the product to a first temperature high enough to dissolve soluble constituent phase particles into solid solution;

d) maintaining the product at the first temperature long enough to dissolve a major portion of the soluble constituent phase particles;

e) cooling the product from the first temperature, at a first rate that is rapid enough to minimize the precipitation of coarse constituent phase particles, to a second temperature that is below the temperature at which such coarse constituent phase particles will precipitate out;

f) cooling the product from the second temperature, at a second rate that is within a range of about 1–100 degrees F. per hour, to a third temperature that is at least 50 degrees F. below the second temperature;

g) cold working the product; and h) heating the product to a fourth temperature sufficient to cause recrystallization.

26. The method of claim 25, wherein the cold working of the product is carried out without any subsequent annealing.

27. The method of claim 25, wherein the cold working comprises cold rolling to reduce the thickness of the product.

28. The method of claim 27, wherein the cold rolling comprises one or more cold rolling passes and a reduction in thickness of at least 10% is obtained in each cold rolling pass.

29. The method of claim 27, wherein the maximum reduction in thickness is obtained on the final cold rolling pass.

30. The method of claim 27, wherein a total reduction in thickness of at least 40% is obtained.

31. The method of claim 25, wherein after the product is raised to the fourth temperature, it is cooled, and then aged.

32. The method of claim 25, wherein the temperature of the product is raised to the fourth temperature at a rate such that the increase to the fourth temperature is achieved within about four hours.

33. The method of claim 25, wherein the fourth temperature is high enough to subject the product to solution heat treatment.

34. The method of claim 33, wherein after the product is subjected to solution heat treatment, it is subjected to an ambient temperature water quench.

35. The method of claim 25, which imparts to the product an average grain size of less than about 30 microns.

36. The method of claim 25 in which (f) is performed immediately after (e) without allowing the product to remain at the second temperature.

37. The method of claim 25 in which the product is cooled from the third temperature to cold working temperature prior to (g).

38. A method for imparting a fine grain structure to an aluminum product having greater than 75% by weight aluminum, which method comprises:

a) heating the product to a first temperature within the range of about 800–1100 degrees F. to dissolve soluble constituent phase particles into solid solution;

b) maintaining the product at the first temperature for a period of time within the range of about fifteen minutes to four hours to dissolve a major portion of the constituent phase particles;

c) cooling the product from the first temperature, at a first rate that is rapid enough to minimize the precipitation of coarse constituent phase particles, to a second temperature that is within the range of about 650–800 degrees F.;

d) cooling the product from the second temperature, at a second rate that is within a range of about 1–100 degrees F. per hour, to a third temperature within the range of about 400–600 degrees F.;

e) cold working the product; and f) raising the temperature of the product to a fourth temperature within the range of about 400–1000 degrees F. to cause recrystallization.

39. The method of claim 38, wherein the first rate and the second rate are each within the range of about 25–50 degrees F. per hour, and cooling from the first temperature through the second temperature to the third temperature is carried out in an uninterrupted fashion.

40. The method of claim 38, wherein the first rate is within the range of about 100–300 degrees F. per hour.

41. The method of claim 38, wherein the second rate is within the range of about 10–25 degrees F. per hour.

42. The method of claim 38, wherein the cold working of the product is carried out without any subsequent annealing.

43. The method of claim 38, wherein the cold working of the product is cold rolling to reduce the thickness of the product.

44. The method of claim 43, wherein the cold rolling comprises one or more cold rolling passes, a reduction in thickness of at least 10% is obtained in each cold rolling pass, and a total reduction in thickness of at least 60% is obtained.

45. The method of claim 43, wherein the maximum reduction in thickness is obtained on the final cold rolling pass.

46. The method of claim 38, wherein the fourth temperature is high enough to subject the product to solution heat treatment.

47. The method of claim 38, wherein the temperature of the product is raised to the fourth temperature at a rate such that the increase to the fourth temperature is achieved within about four hours.

48. The method of claim 38, which imparts to the product an average grain size within the range of about 15–30 microns.

49. The method of claim 38 in which (d) is performed immediately after (c) without allowing the product to remain at the second temperature.

50. The method of claim 38 in which the product is cooled from the third temperature to cold working temperature prior to (e).

51. A method for treating an aluminum alloy product in order to improve formability and surface finish characteristics, which method comprises:

a) heating the product to a first temperature high enough to dissolve soluble constituent phase particles into solid solution;

b) maintaining the product at the first temperature long enough to dissolve a major portion of the soluble constituent phase particles;

c) cooling the product from the first temperature, at a first rate that is rapid enough to minimize the precipitation of coarse constituent phase particles, to a second temperature that is below the temperature at which such coarse constituent phase particles will precipitate out;

d) cooling the product from the second temperature, at a second rate that is within a range of about 1–100 degrees F. per hour, to a third temperature that is at least 50 degrees F. below the second temperature;

e) cooling the product from the third temperature to cold working temperature;

f) cold working the product; and g) heating the product to a fourth temperature sufficient to cause recrystallization.

* * * * *